US005689752A

United States Patent [19]

Bolognese et al.

[11] Patent Number: 5,689,752

[45] Date of Patent: Nov. 18, 1997

[54] PROCESSING APPARATUS, METHOD, AND SYSTEM FOR PHOTOSENSITIVE MATERIALS

[75] Inventors: Renato Bolognese, Savona, Italy; Basavaraj R. Desai, Knoxville, Tenn.

[73] Assignee: Minnesota Mining and Manufacturing Company, St. Paul, Minn.

[21] Appl. No.: 590,159

[22] Filed: Jan. 23, 1996

[51] Int. Cl.[6] ..... G03D 3/02

[52] U.S. Cl. ..... 396/626; 396/627

[58] Field of Search ..... 354/322, 324, 354/325, 331, 336; 118/637; 396/622, 626, 636, 627, 630

[56] References Cited

U.S. PATENT DOCUMENTS

| | | | |
|---|---|---|---|
| 5,059,997 | 10/1991 | Hall et al. | 354/324 |
| 5,136,323 | 8/1992 | Frank et al. | 354/320 |
| 5,168,926 | 12/1992 | Watson et al. | 165/185 |
| 5,266,994 | 11/1993 | Desai et al. | 354/317 |
| 5,365,299 | 11/1994 | Desai | 354/324 X |
| 5,420,658 | 5/1995 | Manico et al. | 354/325 X |
| 5,481,328 | 1/1996 | Verhoest et al. | 354/325 X |
| 5,502,535 | 3/1996 | Desai | 354/324 |

FOREIGN PATENT DOCUMENTS

| | | | |
|---|---|---|---|
| 0 410 322 A2 | 7/1990 | European Pat. Off. . | |
| 0 622 678 A2 | 11/1994 | European Pat. Off. . | |
| 0 647 881 A1 | 4/1995 | European Pat. Off. . | |
| 61-210355 | 9/1986 | Japan | 354/325 |
| 2-91646 | 3/1990 | Japan | 354/325 |
| 5-11421 | 1/1993 | Japan | 354/325 |
| 1 482 080 | 8/1977 | United Kingdom . | |
| WO 93/00612 | 1/1993 | WIPO . | |

*Primary Examiner*—D. Rutledge
*Attorney, Agent, or Firm*—William K. Weimer

[57] ABSTRACT

An apparatus adapted for use in the processing of a material traveling in a material direction, such as a photosensitive material. The apparatus directs a first fluid stream and a second fluid stream respectively across the first and second width portions of the material. The first and second fluid streams do not flow substantially cocurrently with nor countercurrently to the material direction.

23 Claims, 3 Drawing Sheets

PROCESSING APPARATUS, METHOD, AND SYSTEM FOR PHOTOSENSITIVE MATERIALS

FIELD OF THE INVENTION

The present invention relates to an apparatus and method for applying a fluid to a moving substrate and more particularly to an apparatus and method for processing (e.g., development, bleaching and/or fixing) of photographic materials.

BACKGROUND OF THE ART

The development of photographic materials is a well-known process. The uniformity and reproducibility of development is dependent on a number of factors including temperature, chemical activity and agitation of the developer solution. Automated processors controlling various aspects of these factors are commonly used for developing photographic elements. Processors use well-known technology to carefully control parameters of the development process. Temperature controls permitting limitations in temperature variations to ±0.5° C. (±1° F.) are routine. In addition, some degree of movement of the processing fluid (a.k.a. agitation) is important and various methods are available for creating this movement within the processing liquids. Among such available methods are roller movement and recirculation of the bath liquid. The chemical activity of the processing bath is maintained through an automated replenishment process.

It is desirable to reduce the amount of materials used in the processing of photographic film from both an economic and ecological point of view. While a square-meter, dry sheet of silver halide imaging material can imbibe up to 40 milliliters of developer fluid, inefficient fluid usage occurs in known developers via excessive leakage from the chamber and gradual deterioration due to oxidation. Manufacturers of newer silver halide developers have attempted to optimize the processing of silver halide materials as efficiently as possible using the least amounts of processing chemicals, while assuring no sacrifice in the high quality of performance that is expected of such materials.

Maintenance of the appropriate level of chemical activity is an important aspect of the development process which assures consistent performance for the product. During development, components of the developer are depleted as reactants are consumed and reaction products are formed. Of particular note are the depletion of hydroquinone and hydroxide ion as reactants and the ultimate formation of hydroquinone monosulfonate or hydroquinone disulfonate and a bromide ion as reaction products. The depletion of the reactants and formation of the reaction products lead to deterioration of the processing bath's capability to develop further images. The leaching of materials from the photographic element can also lead to a deterioration of development quality. It is the role of agitation to remove the reaction products from the surface of the photographic medium and to provide fresh chemistry to the surface of the medium to assure continued development of the medium by diffusion into the layer where the image-forming reaction is occurring. It is the role of replenishment to provide a continued supply of reactants and dilution of the reaction products to maintain the overall chemical activity for the processing bath.

The replenishment requirements and sustained capacity of a processing bath to develop film are determined by a number of factors including the silver content of the film, the degree to which the silver halide crystals are converted to image silver (i.e., the usage rate) and the formulation of the developer. A goal is to achieve a steady state in which the replenishment maintains the activity of the bath at a constant level to provide consistent and reproducible development results. Under-replenishment, i.e., insufficient replenishment, leads to deterioration of the processing bath with a decreased processing activity. A result of under-development is insufficient image (low density), low contrast and eventually exhaustion where there is little or no development. Over-replenishment, on the other hand, can lead to a condition in which the activity of the bath becomes excessive and results in over-development, excess image (high density), high contrast and excessive fogging (Dmin) of the film. Conventionally, the recommended practice to provide consistency has been to use a very large reservoir of reactants, which is wasteful with respect to the chemicals being used.

A distinction must be made between the developer in the processing bath and the developer in the replenisher, which is added to maintain the activity of the bath. The developer within the bath, also known as the working developer, may be derived from the replenisher. However, the working developer in an automated processor includes reaction byproducts as well as a reduced level of reactants when compared to the replenisher. In a steady state situation, the developer and reaction products remain at a constant level, accumulating reaction products and depleting reactants during development, while replenishment supplies fresh reactants and dilutes the reaction byproducts. At a proper replenishment rate, the system maintains an approximately steady state balance providing consistent development for the photographic film. The use of a replenisher solution for the development of a film in a replenisher would normally result in an over-developed image, as the replenisher solution is a stronger developing bath than the seasoned or working developer bath. It is, however, common in the art to prepare a working developer bath from a replenisher by either diluting the replenisher solution, adding some reaction products, e.g., bromide, running some exposed film through without replenishment, or some combination to suppress the excess activity of the replenisher and bring it to the level of the working developer.

To assist in maintaining consistent chemical activity, it is common practice that automated processors have a developer bath with a significant volume of liquid, e.g., 20 liters or more. These are generally called "deep tank processors". Deep tank processors have provided the highest throughput rate and have provided a buffering capacity for the developer bath which contributes to the consistency of the process.

Disadvantages of deep tank processors, however, are significant. First and probably foremost, the use and eventual disposal of a large volume of processing fluid is ecologically undesirable. This disadvantage is accentuated when the operator is caused to dump a large volume of fluid due to incorrect mixing or due to fluid contamination. Second, the large volume is economically undesirable to purchasers. Third, a significant period of time is required to heat the large volume to the desired operating temperature.

Shallower tanks or reduced volume tanks have been made commercially available to address the disadvantages of the deep tank processors. However, they have not met with significant acceptance. One of the primary reasons for lack of general acceptance is that low-volume processors traditionally have either not provided the output requirements (productivity for processing imaging material, i.e., throughput rate) or not provided the consistency of performance (development uniformity without scratching, pressure marking, or creating other artifacts in the imaging material) that are provided by deep tank processors.

U.S. Pat. No. 5,168,926 describes a processor with partitioned processing chambers designed to use a smaller volume and provide proper development. This patent not only reports the use of a lower fill volume but also a reduced usage rate for the replenisher (milliliters per square meter).

WO Patent No. 93-00612 defines an apparatus for photographic processing in a low-volume tank and teaches the importance of agitation. It states that in low-volume processors, the confines of the tank restrict adequate agitation and, therefore, access of fresh processing solution to the film surface. The patent defines means to assure the access of fresh processing solution to the film surface.

In EPO Patent No. 410322, the chemistry is dispensed directly onto the film for processing. Such imbibement processing requires that the chemistry be formulated so there are sufficient reactants in the volume imbibed to assure full development of the image. EPO Patent No. 410322 requires a minimum of two dispensings of the developer formulation. However, the material dispensed does not become part of the developer in a processing tank.

U.S. Pat. No. 5,059,997 is an example of a low-volume tank which attempts to effectively limiting contact of the solution with air and thereby reduce degradation of the developer by oxidation.

U.S. Pat. No. 5,266,994 is example of a low-volume processing tank which includes a plurality of fingers which are intended to distribute processing solution over the surface of the material being processed.

As previously noted, chemical activity is maintained by replenishment in which flesh chemistry is added at a rate commensurate with the quantity (area) of film processed, or more properly, the quantity of shaver image that is developed. For most processes in the industrial black and white markets, e.g., the medical and graphic arts areas, the prescribed replenishment rate is usually about 450 milliliters of the replenishment chemistry per square meter of film processed, with assumptions that the development process develops about 50% of the available shaver and that the silver coating weight of the materials used is in the range of 3 to 4 grams per square meter of film processed. In processes where the preponderance of film going through the process has a different shaver coating weight or the balance of silver converted to image is significantly different than 50%, the recommended replenishment rate is normally adjusted to compensate for the differences.

As an example, for 50% imaged or exposed films, the data sheets for one company's products generally recommend 39 milliliters per square foot for 50% imaged shaver halide photographic film (53 milliliters per square foot for 75% imaged film). The 39 milliliters per square foot is equivalent to 420 milliliters per square meter. Some use as low as 29 milliliters per square foot can be envisaged, which is equivalent to 312 milliliters per square meter. Other uses in the range of 22 to 35 milliliters per square foot for 50% imaged film, which is equivalent to 235 to 375 milliliters per square meter, have been recommended. In this regard, it should be noted that while a number of patents refer to the benefits of low-volume processor tanks and the resultant reduction in chemistry usage, such references are always to the tank volumes and the requirements associated with filling or dumping such tanks. None of the references appear to refer to the requirements of replenishment other than that replenishment conventionally used to maintain the process over an extended period of time and to provide extended usage of developer materials.

One known, commercially available processing chemistry formulation achieves a reduction in the volume of replenishment chemistry used. However, the volume reduction does not translate to an equivalent reduction in the material usage, e.g., the absolute amount of hydroquinone (HQ) used. While using this formulation allows for a reduction of the replenishment volume from 0.450 to 0.125 liters per square meter of film developed, the concentration of the hydroquinone used in the processing bath is increased by 1.5 to 2 times that of a normal concentration (from 50 to 80, but nominally 65 grams HQ per liter to approximately and nominally 113.8 grams HQ per liter). As a result, the usage of HQ is only reduced from 29.3 grams per square meter (at a 50% image) to about 14.3 grams HQ per square meter. This usage still results in a significant waste of HQ. (Approximately 1 gram of HQ is all that is used per square meter of film developed when the processing fluid includes 65 grams HQ/liter, the film includes 4 grams Ag/square meter of film developed, and the film is 50% imaged.)

A need remains for an apparatus and method which a) minimize the use of the chemicals involved (via the reduction of fluid loss, efficient usage of the chemicals, and/or the reduction of oxidation), b) minimize the scratching and/or pressure marking of the material while being transported through the apparatus, and c) provides adequate development uniformity and productivity. This need is particularly felt for processing imaging materials, such as photographic films, proofing plates, and diffusion transfer-type imaging materials, particularly wider imaging materials.

SUMMARY OF THE INVENTION

The present invention addresses the problems associated with deep tank processors and known small volume processors. In one embodiment, the present invention is directed to an apparatus adapted for use in the processing of a photosensitive material traveling in a material direction. The photosensitive material has a material width including a first width portion and a second width portion. The first and second width portions are smaller than the material width. The apparatus includes a housing having a processing chamber for containing processing fluid. The housing has at least one material port for allowing the photosensitive material to pass through the processing chamber. The apparatus includes an ability operatively coupled to the housing for directing at least one first stream of processing fluid across the first width portion and for directing at least one second stream of processing fluid across the second width portion of the photosensitive material. The at least one first stream and the at least one second stream do not move substantially cocurrently with nor countercurrently to the material direction.

Another embodiment of the present invention includes a method for processing a photosensitive material which is moveable in the material direction. The photosensitive material has a material width including a first width portion and a second width portion. The first and second width portions are each smaller than the material width. The method includes the step of providing a housing having a processing chamber for containing a processing fluid. The housing has at least one material pen allowing the photosensitive material to move through the processing chamber. Another step is transporting the photosensitive material into the processing chamber. Another step is directing a first stream of processing fluid across the first width portion. The first stream does not move substantially cocurrently with nor countercurrently to the material direction. Another step includes directing a second stream of processing fluid across the second width portion, the second stream not moving substantially cocurrently with nor countercurrently to the material direction. Another step includes transporting the photosensitive material out of the processing chamber.

Another embodiment of the present invention includes a method for applying a treatment fluid to a treatable material which is moving in the material direction. The treatable material has a material width including a first width portion and a second width portion. The first and second width portions are each smaller than the material width. The method including the step of providing a housing having a treatment chamber for containing the treatment fluid. The housing also has at least one material port allowing the treatable material to move through the treatment chamber. Another step is transporting the treatable material into the treatment chamber in a material direction. Another step is directing a first stream of treatment fluid across the first width portion of the treatable material. The first stream does not move substantially cocurrently with nor countercurrently to the material direction. Another step includes directing a second stream of treatment fluid across the second width portion of the material. The second stream does not move substantially cocurrently with nor countercurrently to the material direction. Another step includes transporting the treatable material out of the processing chamber.

DETAILED DESCRIPTION OF THE PREFERRED EMBODIMENTS

Figure 1:
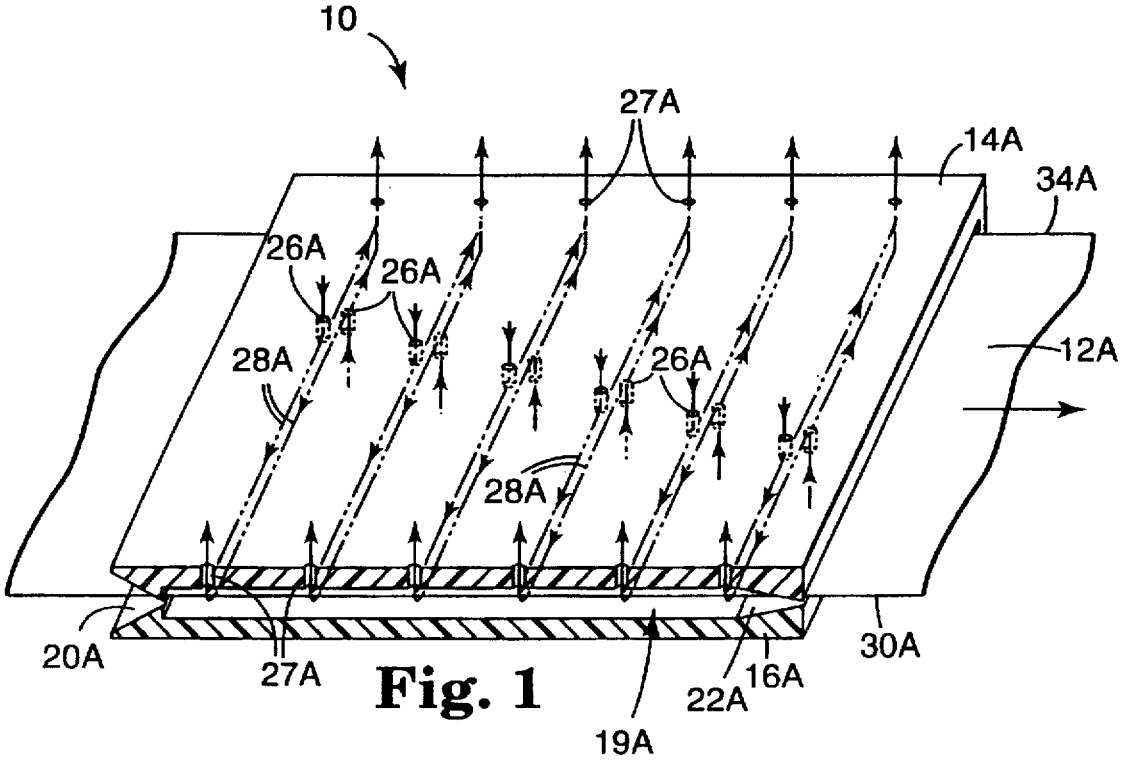
FIG. 1 is an isometric sectional schematic view of an embodiment in accordance with the present invention.

An apparatus 10 shown in FIGS. 1–4 can be used in the processing of an imaging material 12 or element, such as an exposed photographic film sheet coated on at least one side thereof with a photosensitive emulsion (e.g., silver halide photographic emulsion). The term "sheet" is used here to refer to a material having a relatively short length, such as an 8-inch by 10-inch sheet, or a material having a relatively long length, such as an 11-inch wide material rolled up on a core or fan-folded like computer paper.

The imaging materials 12 processable with the apparatus 10 can also include proofing plates and diffusion transfer imaging material. Examples of proofing plates are the MATCHPRINT™ printing plates and VIKING™ printing plates (both made by 3M Company, St. Paul, Minn., USA). An example of such a diffusion transfer imaging material is the ONYX™ printing plate (made by 3M Company, St. Paul, Minn., USA).

The terms "processing," "processable," and variations thereof are used to mean developing, fixing, and/or washing, when referring to a photographic film sheet or other similar imaging material. The same terms are used to mean developing/activating, stabilizing, and/or washing when referring to diffusion transfer-type imaging material. The same term can be used to mean applying a fluid to a substrate which is treatable by the application of the fluid.

Two types of graphic arts developers, EXCELERATE™ (a hybrid chemistry) and rapid access developer, and various radiographic processing solutions have been used within the apparatus 10. The apparatus 10 can be useful with diffusion transfer developers, or activator type systems for plate processing, as well as graphic arts hybrid films, scanner fills, contact films, radiographic conventional screen films, and laser films.

The apparatus 10 can generally comprise a two-piece assembly including a top plate 14 and a bottom plate 16 relatively aligned to provide a processing cell 18 or housing having a processing chamber 19 between the top plate 14 and the bottom plate 16. A material inlet port 20 and a material exit port 22 communicate with the processing chamber 19 to allow the imaging material 12 to pass through the processing chamber 19. One embodiment of the processing chamber 19, when designed to process a 10-inch by 12-inch (25.4 centimeter by 30.48 centimeter) sheet of imaging material 12 can have an interior length (from the material inlet port 20 to the material exit port 22) of approximately 8 inches (20.3 centimeters); an interior width of approximately 16 inches (40.6 centimeters); and, an interior height of approximately 0.1 inch (0.254 centimeter).

One embodiment of the processing chamber 19, when designed to process a 10-inch by 12-inch (25.4-centimeter by 30.48-centimeter) sheet of imaging material 12 can have a chamber length (from the material inlet port 20 to the material exit port 22) of approximately 8 inches (approximately 20.3 centimeters). The chamber width could be approximately 16 inches (approximately 40.6 centimeters). And, the chamber height could range from approximately 0.10 to 0.3 inch (approximately 0.254 to 0.762 centimeter). (The chamber height is the distance from the inner surface of the bottom plate 16 to the inner surface of the top plate 14.) The volume of the processing chamber 19 within this embodiment would range from approximately 12.8 to 38.4 cubic inches (approximately 210 to 629 cubic centimeters).

The chamber height could, instead, be slightly less than the previously noted range. However, maintaining desired flow rates can be difficult when the chamber is significantly less than this range. Conversely, the chamber height could be greater than this range, for example, up to approximately 2 to 4 inches (approximately 5 to 10 centimeters), by changing the shape of the bottom plate 16 to define a deeper trough. However, as the depth of that bottom plate trough increases, the benefits of a small volume processor are diminished.

The chamber height of the processing chamber 19 can be chosen such that the processing fluid 24 (not shown in the drawings) has a desired fluid thickness contacting the sensitized surface or surfaces of the imaging material 12. In other words, a desired fluid thickness of processing fluid should contact the sensitized surface of a "single-sided" imaging material, such as a printing plate (e.g., ONYX™ plates), or should contact both sensitized surfaces of a "two-sided" imaging material such as some radiographic films. The desired thickness should be between a thickness which uniformly processes the imaging material 12 and a thickness which minimizes the total volume of the processing fluid and allows for the benefits provided by a smaller volume of processing chemicals. An example of a range of the desired thickness could be from 0.04 to 0.4 inch (approximately 0.1 to 1.0 centimeter). So, when the apparatus 10 is processing a particular "single-sided" imaging material (e.g., transported with the sensitized surface facing the top plate 14), the distance between the inner surface of the bottom plate 16 and the top surface of the processing fluid should be at least equal to 0.04 inch plus the thickness of that particular "single-sided" imaging material 12. Or, when the apparatus 10 is processing a particular "double-sided imaging" material 12, the distance between the inner surface of the bottom plate 16 and the top surface of the processing fluid should be at least equal to 0.08 inch (two 0.04 inch fluid layers) plus the thickness of that particular "double-sided" imaging material 12. Furthermore, a greater fluid thickness than 1.0 centimeter would function, such as a thickness of 2.5 centimeters or more. But, as previously noted, as the thickness increases, the benefits of using a smaller volume of processing chemicals are diminished.

With a 0.04-inch fluid thickness on only one surface of the imaging material 12, the volume of processing fluid within the previously noted embodiment of the processing chamber 19 (approximately 8 inches long, 16 inches wide) would be approximately 5.12 cubic inches (approximately 84 milliliters). With a 0.4-inch fluid thickness, the volume of processing fluid would be 51.2 cubic inches (approximately 840 milliliters).

Another embodiment of the processing chamber 19, when designed to process a wider imaging material 12, can have an interior length of approximately 16 inches (approximately 40.6 centimeters), an interior width of approximately 24 inches (approximately 61 centimeters), and an interior height (and fluid thickness range) similar to that previously described.

The processing chamber 19 can have dimensions which are different from those just noted, for example, to affect the throughput rate and/or the fluid volume within the processing chamber 19. In addition, the size of the processing chamber 19 can be made smaller (e.g., 30-centimeter width) or larger to accommodate narrower or wider imaging materials, respectively, and imaging materials of various thickness. Furthermore, the inner surfaces of the top and bottom plates 14, 16 could be irregularly shaped, rather than flat as shown.

The imaging material 12 is shown as traveling in a traveling direction (as shown by the arrow) and creates a traveling plane. The processing fluid is shown flowing substantially transversely across the imaging material 12 due to the orientation of the fluid inlet ports 26 and the fluid outlet ports 27. A volume of liquid is circulated through the processing chamber 19 which is in contact with the imaging material 12 while it is within the processing chamber 19. Circulation is commonly referred to in terms of turnovers. The term "turnover" means the volume of processing fluid contained within the processing chamber 19. The circulation of the processing liquid through the processing chamber 19 is required to maintain a minimum flow of 0.2 turnovers of the processing liquid every minute in a direction which is transverse to the movement of the imaging material 12 through the processing chamber 19. More preferably, the circulation flow rate is greater than 0.4 turnovers/minute and, most preferably, greater than 0.6 turnovers/minute.

For processing the imaging material 12, the total volume of the processing fluid within the processing chamber 19 can be less than or equal to 0.08 milliliter of a developer liquid per square centimeter of surface area of the processing chamber 19. For example, a processing chamber 19 which is 8 inches long (approximately 20.3 centimeters), 16 inches wide (approximately 40.6 centimeters) has a surface area of 128 square inches (approximately 825.8 square centimeters). The volume of processing fluid within this processing chamber 19 would preferably be less than or equal to approximately 66 milliliters. For another example, a processing chamber 19 which is 16 inches long (approximately 40.6 centimeters), inches wide (approximately 60.9 centimeters) has a surface area of 384 square inches (approximately 2477.4 square centimeters), the volume of processing fluid 24 within the processing chamber 19 would preferably be less than or equal to approximately 198 milliliters.

It is important to note that as dimensions of the processing chamber 19 are changed, the flow characteristics within the processing chamber 19 will change. As the width of the processing chamber 19 is increased to accommodate a wider imaging material, the flow characteristic are directly impacted. A processing chamber 19 that is only 6 inches (15.24 centimeters) wide has flow characteristics which are significantly different than those of a processing chamber that is 30 inches (76.2 centimeters) wide. Feeding the processing chamber 19 only along one side and extracting only at the other side (a single transverse flow) becomes increasingly difficult with a wider and reduced-height processing chamber 19. As the processing chamber 19 gets wider and/or reduced in height, increasing flow resistance within the processing chamber 19 will lead to the processing fluid flowing out of the processing chamber 19 through the material inlet and/or exit ports 20, 22 rather than to flow to the other side of the processing chamber 19 where it is being extracted. In other words, the processing fluid takes the path of least resistance. This can cause uneven distribution of the processing fluid across the imaging material. In addition, the activity of the processing fluid can decrease as the processing fluid 24 flows across the imaging material 12. This can have the undesirable effect of uneven development within the imaging material 12.

The apparatus 10 addresses these problems, especially when processing relatively wide imaging material 12. Generally, the apparatus 10 somewhat divides the width of the processing chamber 19 into smaller flow regions. This division of the processing chamber 19, if you will, is accomplished by having multiple flow streams 28 (one group of flow streams flows along the top surface of the imaging material and the other group of flow streams flows along the bottom surface of the imaging material) of processing fluid rather than a single stream. The multiple flow streams 28 can more uniformly distribute the processing fluid across the imaging material 12. In addition, the shorter flow streams 28 provide a more consistent level of activity within the processing fluid and a more uniform development of the imaging material 12. Moreover, the flow rate of the multiple flow streams across a relatively wide imaging material 12 can be similar to the flow rate of a single stream across a smaller imaging material 12 without causing increased fluid loss through the material inlet and outlet ports 20, 22. In other words, dividing a single flow into multiple flows can allow for a reduced flow rate.

The apparatus 10 can create these multiple flow streams 28 by including a specific arrangement between the fluid inlet ports 26 (fluid supply)and the fluid outlet ports 27 (fluid drain). In FIG. 1, the fluid inlet ports 26A are shown in two groups, one group communicating with the processing chamber through the top plate 14A and one group through the bottom plate 16A. Two groups of fluid outlet ports 27A are shown as communicating with the processing chamber 19A through the top plate. The two groups of fluid outlet ports 27A are positioned at (or near) the chamber side ends such that processing fluid exits the processing chamber 19A at or near the edges 30A, 34A of the imaging material 12A (when the width of the imaging material 12A is not significantly less than the width of the processing chamber 19A; i.e., the exits are at the edges of the processing chamber 19A). Each group of fluid inlet ports 26A is positioned between the two groups of fluid outlet ports 27A causing two groups of outwardly flowing flow streams 28A along the top surface of the imaging material 12A and along the bottom surface of the imaging material 12A. The fluid ports 26, 27 make up a portion of the fluid conduits which supply and drain the chamber 19A. (The remaining portions of the conduits are not shown, nor is the source of the fluid.)

Figure 2:
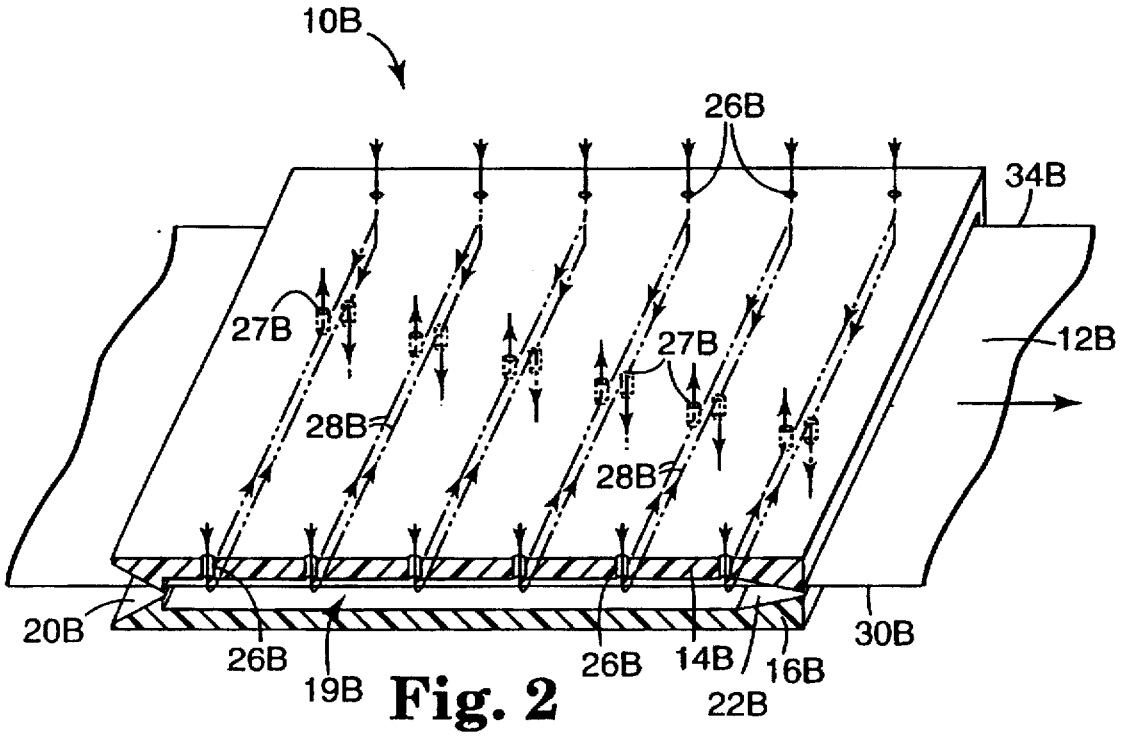
FIG. 2 is an isometric sectional schematic view of the another embodiment of the apparatus shown in FIG. 1.

As shown in FIG. 1 and, the groups of fluid inlet ports 26A can be arranged to run, for example, diagonally across the processing chamber 19A. (FIG. 2 shows diagonally positioned fluid outlet ports 27B.) By not being parallel to the groups of fluid outlet ports 27A nor aligned such that fresh fluid is provided at different positions along the width of the imaging material 12A, the fluid inlet ports 26A can provide for a more uniform distribution of the fluid in the chamber 19A to allow for more uniform development. Rather than diagonally, the fluid inlet ports 26C (or the fluid outlet ports 27B of FIG. 2) could be positioned in more era zig-zag pattern, as shown in FIG. 3.

In FIG. 2, another embodiment of the apparatus 10B creates a different arrangement of multiple flow streams 28B by virtually switching the locations of the groups of fluid inlet ports 26B with the two groups of fluid outlet ports 27B. This arrangement creates two groups of inwardly flowing flow streams 28B, again, along the top and bottom surfaces of the imaging material 12B.

Other arrangements are contemplated. For example, the fluid inlet ports and outlet ports can be located to only create flow across one surface of the imaging material 12B, rather than both top and bottom surfaces. Or, the fluid inlet and outlet ports can be positioned such that the flow streams 28B are not transverse, i.e., not perpendicular, to the transporting direction of the imaging material. Instead, the flow streams can be more diagonal to the transporting direction of the imaging material, i.e., angle A could be between 90 degrees (transverse) and, for example, 45 degrees (diagonal) to the transporting direction, as shown in FIG. 3. The angle could even be less than 45 degrees, say to 30 degrees. Still other variations are easily envisioned. The result would still be the ability to create multiple flow fluid streams 28 which cross the edges 30, 34 of the imaging material.

Figure 3:
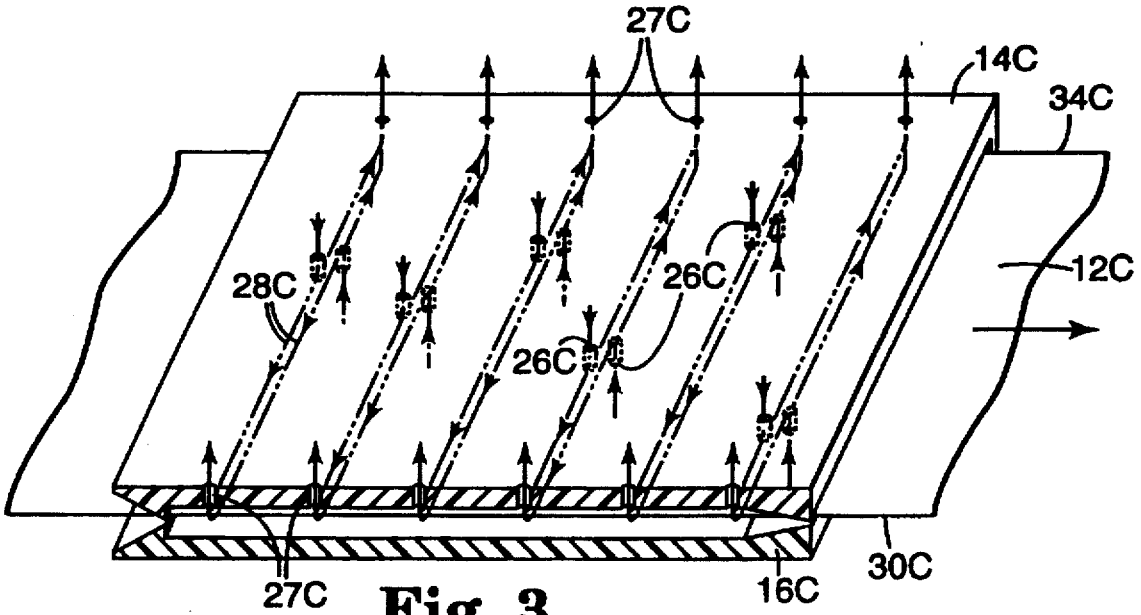
FIG. 3 is an isometric sectional schematic view of another embodiment of the apparatus shown in FIGS. 1 and 2.

While the inlet ports 26B in FIG. 2 and the outlet ports 27A, 27C in FIGS. 1 and 3 are shown as communicating through the edges of the top plate 14, they could instead be communicating through the bottom plate 16. Similarly, the ports could be positioned through a side plate (not shown) such that the fluid enters or exits more horizontally, rather than vertically. Still further, a combination of these possibilities could be used. For example, pairs of ports could be used such that they communicate to the chamber 19 through both the top plate 14 and the bottom plate 16 (fluid could be supplied or extracted through both plates).

Figure 4:
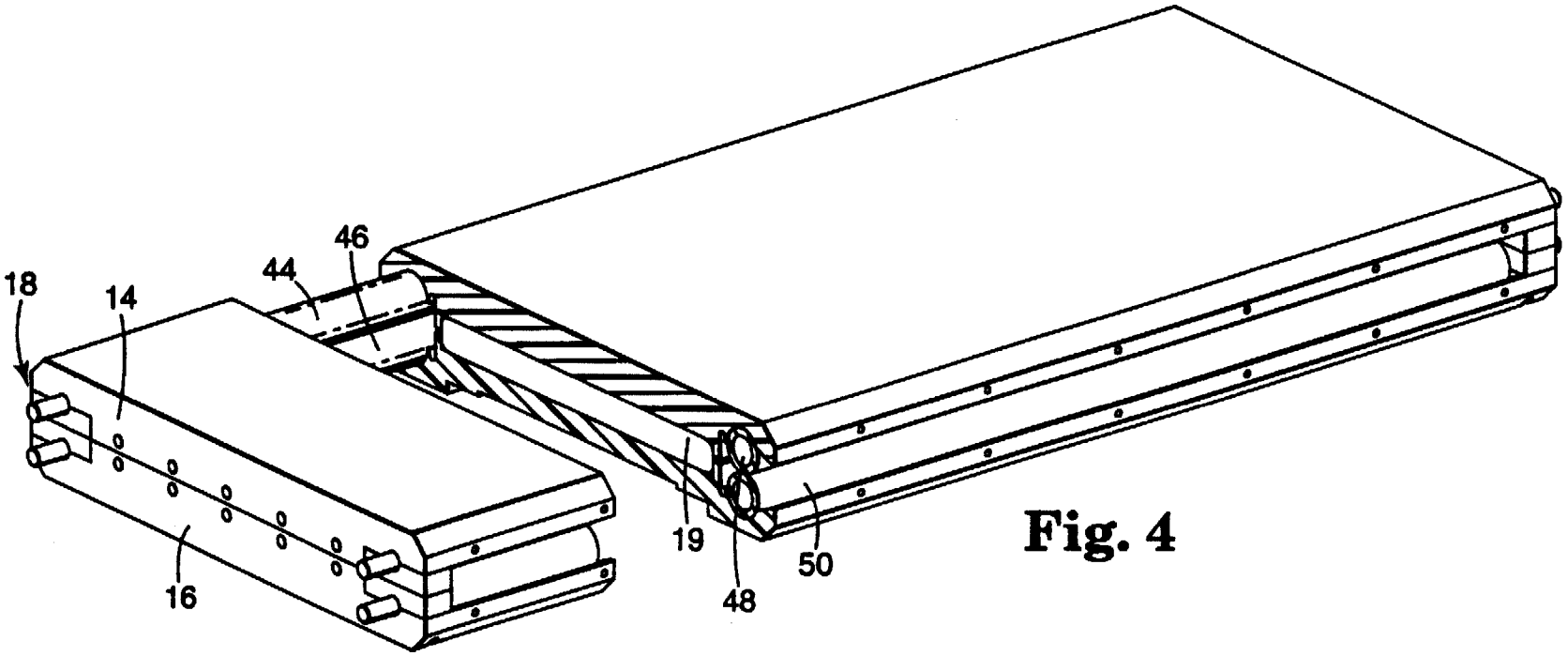
FIG. 4 is an isometric sectional schematic view of another embodiment of the apparatus shown in FIG. 1–3.

Another feature which can be incorporated is one which closes the cell 18, as is shown in FIG. 4. By "closed," it is meant that the cell 18 significantly minimizes, if not prevents, contact between the processing fluid and ambient air. Accordingly, the oxidation of the processing fluid can be reduced and the activity of the processing fluid can be extended. This is particularly effective for the periods of time when the apparatus is idle and the processing fluid is not being applied to an imaging material 12. To accomplish this, the processing cell 18 can include an upper inlet port roller 44 and a lower inlet port roller 46, which can be within or in close proximity to the material inlet port 20, and an upper outlet port roller 48 and a lower outlet port roller 50, which can be within or in close proximity to the material outlet port 22.

The upper inlet port roller 44 can be positioned such that no gap exists between the upper inlet port roller 44 and the lower inlet port roller 46. These rollers 44, 46 can be made of a sufficiently resilient material (such as silicone rubber) such that the rollers 44, 46 give when an imaging material 12 is transported between them. It is, however, possible to position the two rollers 44, 46 such that a gap exists between them. Or, one of the rollers 44, 46 could be moveable relative to the other such that when no imaging material 12 is between the rollers 44A 46, the gap can closed, and such that the gap can be increased when an imaging material 12 is introduced to the rollers 44, 46. The same arrangements would work for the upper and lower outlet port rollers 48, 50.

In place of the port rollers 44, 46, 48, 50, air contact with the fluid can be minimized by including port doors (not shown) which can be closed when no imaging material 12 is being transported through the cell. Other variations are envisioned to provide this benefit.

Figure 5:
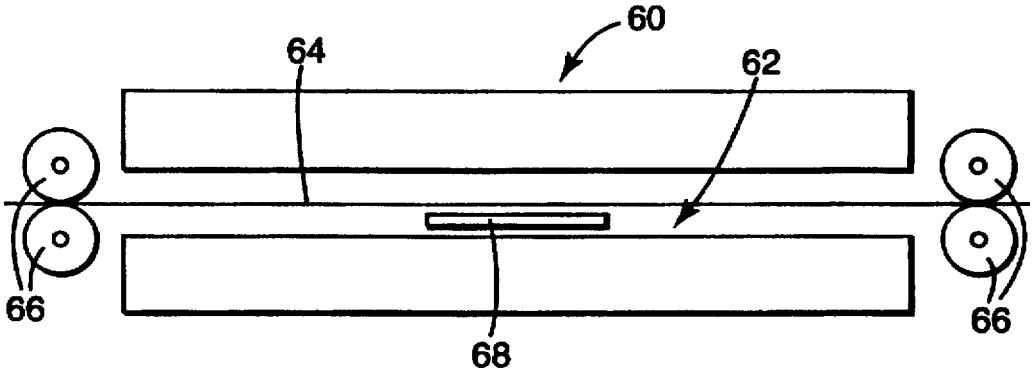
FIG. 5 is a side schematic view of another embodiment of the apparatus shown in FIGS. 1–4 which is particularly suited for electroplating a substrate.

While the apparatus 10 has been referred to as relating to the processing of a photosensitive material (developing, fixing, washing, activating, and/or stabilizing), an embodiment of the apparatus 10 can also be useful for electroplating a metal onto a substrate. FIG. 5 schematically illustrates an electroplating apparatus 60 which, in addition to the features shown in FIGS. 1–4, can include an electroplating chamber 62 containing an electroplating fluid. Generally, a conductive substrate 64 can be plated with a metal by transporting the substrate 64 through the electroplating fluid. The electroplating apparatus 60 can include the features described above with respect to the image-developing embodiment of the apparatus 10.

Conductive rollers 66, positioned at either the inlet or exit of the electroplating apparatus 60 (or both), can be charged and can contact the conductive substrate 64 when the conductive substrate 64 enters and/or exits the electroplating apparatus 60. An oppositely charged electrode 68 within the chamber 62 can be in the shape of a flat plate and can be positioned parallel to the substrate 64. Within one arrangement, the electrode 68 could be a consumable anode, such as a copper electrode within a copper plating fluid, or an inert electrode that passes electrical charge by reacting with the plating fluid. (The conductive rollers 66, in this arrangement would serve as the cathode contact.) Within other plating arrangements, the electrode 68 could serve as the cathode and the conductive rollers 66 could serve as the anode.

The substrate 64 could be a polyimide film which is plated with copper using a copper anode and a $CuSO_4$ solution. The polyimide film can be a film which has a thin copper film (e.g., sputtered) to provide the necessary or desired conductivity to the film which allows for efficient plating. The rate of plating is determined by the potential difference between the substrate and the anode and by the copper ion flow to the substrate 64.

Other substrates can be plated with copper or with other metals, as is known in the art. In addition, other electrode arrangements can be used, as is known in the art. For example, the rollers 66 could be replaced or augmented with a brushes or smaller rollers which contact the edges or other portions of the substrate. With any such variation, the flow of the electroplating fluid which results due to previously described features of the apparatus 10 can be advantageous for electroplating.

More generally, the apparatus 10 can also be useful for coating a fluid, such as an adhesive solution or other similar fluids, onto a substrate or treating a substrate with a particular treatment fluid, such as a protective fluid (e.g., a fluoropolymer fluid). Other variations of the above-described apparatus and methods are contemplated and are within the scope and spirit of the invention.

What is claimed is:

1. An apparatus adapted for use in the processing of a photosensitive material traveling in a material direction, the photosensitive material having a material width including a first width portion and a second width portion, the first and second width portions being smaller than the material width, the apparatus comprising:

a housing having a processing chamber for containing processing fluid, the housing also having at least one material port for allowing the photosensitive material to pass through the processing chamber; and means operatively coupled to the housing for directing at least one first stream of processing fluid across the first width portion and for directing at least one second stream of processing fluid across the second width portion of the photosensitive material, the at least one first stream and the at least one second stream not moving substantially cocurrently with nor countercurrently to the material direction, the directing means being configured such that the first width portion and the second width portion together substantially equal the material width.

2. An apparatus adapted for use in the processing of a photosensitive material traveling in a material direction, the photosensitive material having a material width including a first width portion and a second width portion, the first and second width portions being smaller than the material width, the photosensitive material having an upper material surface and a lower material surface, the apparatus comprising:

a housing having a processing chamber therein for containing processing fluid and at least one material port for allowing the photosensitive material to pass through the processing chamber, the processing chamber having a first chamber side and an opposite second side, the housing comprising:

an upper wall adjacent to the upper material surface; and a lower wall adjacent to the lower material surface;

means operatively coupled to the housing for directing at least one first stream of processing fluid across the first width portion and for directing at least one second stream of processing fluid across the second width portion of the photosensitive material, the at least one first stream and the at least one second stream not moving substantially cocurrently with nor countercurrently to the material direction, the directing means comprising:

at least one first fluid inlet communicating with the processing chamber near the first chamber side for supplying processing fluid to the first stream;

at least one second fluid inlet communicating with the processing chamber near the opposite second chamber side for supplying processing fluid to the second stream; and at least one fluid outlet communicating with the processing chamber between the at least one first fluid inlet and the least one second fluid inlet for removing processing fluid from the processing chamber, the at least one fluid outlet comprising an upper fluid outlet and a lower fluid outlet, the upper fluid outlet communicating with the processing chamber through the upper wall for substantially removing the first and second streams which flow across the upper material surface, the lower fluid outlet communicating with the processing chamber through the lower wall for substantially removing the first and second streams which flow across the lower material surface.

3. The apparatus of claim 2, the first inlet comprising a first inlet manifold having a plurality of first inlet ports, the second inlet comprising at least one second inlet manifold having a plurality of second inlet ports, the upper fluid outlet comprising at least one upper fluid outlet manifold having a plurality of upper fluid outlet ports, and the lower fluid outlet comprising a lower fluid outlet manifold having a plurality of lower fluid outlet ports.

4. An apparatus adapted for use in the processing of a photosensitive material traveling in a material direction, the photosensitive material having a material width including a first width portion and a second width portion, the first and second width portions being smaller than the material width, the apparatus comprising:

a housing having a processing chamber for containing processing fluid, the processing chamber having a chamber length, the housing also having at least one material port for allowing the photosensitive material to pass through the processing chamber; and means operatively coupled to the housing for directing at least one first stream of processing fluid across the first width portion and for directing at least one second stream of processing fluid across the second width portion of the photosensitive material, the at least one first stream and the at least one second stream not moving substantially cocurrently with nor countercurrently to the material direction, the directing means comprising a plurality of fluid outlet ports arranged along at least a portion of the chamber length, the plurality of fluid outlet ports not forming a fluid outlet port line which is parallel with the material direction.

5. The apparatus of claim 4, the plurality of fluid outlet ports comprising a plurality of upper fluid outlet ports and a plurality of lower fluid outlet ports, the plurality of upper fluid outlet ports not forming an upper fluid outlet port line which is parallel to the material direction, the plurality of lower fluid outlet ports not forming a lower fluid outlet port line which is parallel to the material direction, the upper fluid outlet ports not being positioned directly above the lower fluid outlet ports.

6. The apparatus of claim 5, the plurality of upper fluid outlet ports being aligned to form an upper fluid outlet port line, the plurality of lower fluid outlet ports being aligned to form a lower fluid outlet port line, the upper fluid outlet port line not being parallel with the lower fluid outlet port line.

7. An apparatus adapted for use in the processing of a photosensitive material traveling in a material direction, the photosensitive material having a material width including a first width portion and a second width portion, the apparatus comprising:

a housing having a processing chamber for containing processing fluid, the processing chamber having a chamber length along which the material travels, the housing also having at least one material port for allowing the photosensitive material to pass through the processing chamber; and means operatively coupled to the housing for directing at least one first stream of processing fluid across the first width portion and for directing at least one second stream of processing fluid across the second width portion of the photosensitive material, the at least one first stream and the at least one second stream not moving substantially cocurrently with nor countercurrently to the material direction, the directing means comprising a plurality of fluid inlet ports arranged along at least a portion of the chamber length, the plurality of fluid inlet ports not forming a fluid inlet port line which is parallel to the material direction.

8. The apparatus of claim 7, the plurality of fluid inlet ports comprising a plurality of upper fluid inlet ports and a plurality of lower fluid inlet ports, the plurality of upper fluid inlet ports not forming an upper fluid inlet port line which is parallel to the material direction, the plurality of lower fluid inlet ports not forming a lower fluid inlet port line which is parallel to the material direction, the upper fluid inlet ports not being positioned directly above the lower fluid inlet ports.

9. The apparatus of claim 8, the plurality of upper fluid inlet ports being aligned to form an upper fluid inlet port line, the plurality of lower fluid inlet ports being aligned to form a lower fluid inlet port line, the upper fluid inlet port line not being parallel with the lower fluid inlet port line.

10. An apparatus adapted for use in the plating of a material traveling in a material direction, the material having a material width including a first width portion and a second width portion, the first and second width portions being smaller than the material width, the apparatus comprising:

a housing having a plating chamber for containing plating fluid, the housing also having at least one material port for allowing the material to pass through the plating chamber; and means operatively coupled to the housing for directing at least one first stream of plating fluid across the first width portion and for directing at least one second stream of plating fluid across the second width portion of the material, the at least one first stream and the at least one second stream not moving substantially cocurrently with nor countercurrently to the material direction.

11. The apparatus of claim 10, the material having a first side edge and a second side edge, the directing means directing the first stream across the first side edge and directing the second stream across the second side edge.

12. The apparatus of claim 10, the first and second streams moving substantially perpendicularly to the material direction.

13. An apparatus adapted for use in the processing of an imaging material traveling in a material direction, the imaging material having a material width including a first width portion and a second width portion, the apparatus comprising:

a housing having a processing chamber for containing processing fluid, the processing chamber having a chamber length along which the material travels, the housing also having at least one material port for allowing the imaging material to pass through the processing chamber; and means operatively coupled to the housing for directing at least one first stream of processing fluid across the first width portion and for directing at least one second stream of processing fluid across the second width portion of the imaging material, the directing means comprising a plurality of fluid outlet ports arranged along at least a portion of the chamber length, the plurality of fluid outlet ports not forming a fluid outlet port line which is parallel with the material direction.

14. An apparatus adapted for use in the processing of an imaging material traveling in a material direction, the imaging material having a material width including a first width portion and a second width portion, the apparatus comprising:

a housing having a processing chamber for containing processing fluid, the processing chamber having a chamber length along which the imaging material travels; and means operatively coupled to the housing for directing at least one first stream of processing fluid across the first width portion and for directing at least one second stream of processing fluid across the second width portion of the imaging material, the directing means comprising a plurality of fluid inlet ports arranged along at least a portion of the chamber length, the plurality of fluid inlet ports not forming a fluid inlet port line which is parallel with the material direction.

15. An apparatus adapted for use in the plating of a material traveling in a material direction, the material having a material width including a first width portion and a second width portion, the apparatus comprising:

a housing having a plating chamber for containing plating fluid, the plating chamber having a chamber length along which the material travels; and means operatively coupled to the housing for directing at least one first stream of plating fluid across the first width portion and for directing at least one second stream of plating fluid across the second width portion of the material, the directing means comprising a plurality of fluid inlet ports arranged along at least a portion of the chamber length, the plurality of fluid inlet ports not forming a fluid inlet port line which is parallel with the material direction.

16. An apparatus adapted for use in the plating of a material traveling in a material direction, the material having a material width including a first width portion and a second width portion, the apparatus comprising:

a housing having a plating chamber for containing plating fluid, the plating chamber having a chamber length along which the material travels; and means operatively coupled to the housing for directing at least one first stream of plating fluid across the first width portion and for directing at least one second stream of plating fluid across the second width portion of the material, the directing means comprising a plurality of fluid outlet ports arranged along at least a portion of the chamber length, the plurality of fluid outlet ports not forming a fluid outlet port line which is parallel with the material direction.

17. An apparatus adapted for use in the treatment of a material traveling in a material direction, the material having a material width including a first width portion and a second width portion, the apparatus comprising:

a housing having a treatment chamber for containing treatment fluid, the treatment chamber having a chamber length along which the material travels; and means operatively coupled to the housing for directing at least one first stream of treatment fluid across the first width portion and for directing at least one second stream of treatment fluid across the second width portion of the material, the directing means comprising a plurality of fluid inlet ports arranged along at least a portion of the chamber length, the plurality of fluid inlet ports not forming a fluid inlet port line which is parallel with the material direction.

18. An apparatus adapted for use in the treatment of a material traveling in a material direction, the material having a material width including a first width portion and a second width portion, the apparatus comprising:

a housing having a treatment chamber for containing treatment fluid, the treatment chamber having a chamber length along which the material travels; and means operatively coupled to the housing for directing at least one first stream of treatment fluid across the first width portion and for directing at least one second stream of treatment fluid across the second width portion of the material, the directing means comprising a plurality of fluid outlet ports arranged along at least a portion of the chamber length, the plurality of fluid outlet ports not forming a fluid outlet port line which is parallel with the material direction.

19. A method for applying a treatment fluid to a material traveling in a material direction, the material having a material width including a first width portion and a second width portion, the apparatus comprising:

providing a housing having a treatment chamber for containing the treatment fluid, the treatment chamber having a chamber length along which the material travels; and directing at least one first stream of treatment fluid across the first width portion and for directing at least one second stream of treatment fluid across the second width portion of the material, the treatment fluid being directed through a plurality of fluid ports arranged along at least a portion of the chamber length, the plurality of fluid ports not forming a fluid port line which is parallel with the material direction.

20. The method of claim 19, the plurality of fluid ports being a plurality of fluid outlet ports, the plurality of fluid outlet ports not forming a fluid outlet port line which is parallel with the material direction.

21. The method of claim 19, the plurality of fluid ports being a plurality of fluid inlet ports, the plurality of fluid inlet ports not forming a fluid inlet port line which is parallel with the material direction.

22. The method of claim 19, the at least one first stream and the at least one second stream not moving substantially cocurrently with nor countercurrently to the material direction.

23. An apparatus useful for applying a treatment fluid to a substrate, the substrate having a substrate width, the apparatus comprising:

a housing having an treatment chamber for containing treatment fluid, the housing having a substrate port which communicates with the treatment chamber for allowing the substrate to be transported through the treatment chamber, the housing having a first side end and a second side end;

a first group of fluid conduits connected to the housing through which the treatment fluid can flow, the first group being positioned at substantially the first side end; and a second group of fluid conduits connected to the housing and positioned between the first group and the second side end allowing treatment fluid to flow between the first group and the second group and across at least a portion of the substrate width, the second group comprising:

a first fluid conduit positioned at a first position relative to the substrate width; and a second fluid conduit positioned at a second position relative to the substrate width, the second position not coinciding with the first position relative to the substrate width.

* * * * *